United States Patent [19]

Kandler

[11] Patent Number: 4,907,561

[45] Date of Patent: Mar. 13, 1990

[54] IGNITION SYSTEM IN AN AIR-COOLED ENGINE

[75] Inventor: William C. Kandler, New Holstein, Wis.

[73] Assignee: Tecumseh Products Company, Tecumseh, Mich.

[21] Appl. No.: 332,745

[22] Filed: Apr. 3, 1989

[51] Int. Cl.[4] ..... F02P 1/08

[52] U.S. Cl. ..... 123/599; 123/149 C

[58] Field of Search ..... 123/599, 149 C, 651, 123/652, 149 D, 149 R; 315/209 T, 218; 310/70 A

[56] References Cited

U.S. PATENT DOCUMENTS

| | | | |
|---|---|---|---|
| 359,552 | 3/1887 | Bassett | 123/599 |
| 608,896 | 8/1898 | McInnerney | 123/599 |
| 638,933 | 12/1899 | McInnerney | 123/599 |
| 809,268 | 1/1906 | Le Pontois | 123/599 |
| 1,073,020 | 9/1913 | Beck | 123/599 |
| 3,741,186 | 6/1973 | Doi et al. | 123/149 R |
| 3,765,390 | 10/1973 | Loudon et al. | 123/599 |
| 4,375,794 | 3/1983 | Wasmer | 123/149 C |
| 4,791,892 | 12/1988 | Hall | 123/599 |
| 4,829,970 | 5/1989 | Carmichael | 123/599 |

*Primary Examiner*—Raymond A. Nelli

*Attorney, Agent, or Firm*—Albert L. Jeffers; John F. Hoffman

[57] ABSTRACT

An internal combustion engine having a flywheel attached to the crankshaft externally of the crankcase. A permanent magnet is affixed to the flywheel proximate the periphery thereof and has a flat exposed face toward the crankcase. The flywheel has fan blades attached thereto for generating a current of air which flows generally radially away from the flywheel and is directed across the engine cylinder by a blower housing. A solid state ignition module is attached to the crankcase axially spaced from the flywheel toward the crankcase so as to be situated substantially free of the air flow generated by the flywheel. The ignition module has a ferromagnetic core with legs extending parallel to the crankshaft and lying in a plane perpendicular to a radius of the crankshaft. The core legs each have a flat end face disposed parallel to the flat face of the permanent magnet, and are adjustable with respect thereto.

9 Claims, 2 Drawing Sheets

IGNITION SYSTEM IN AN AIR-COOLED ENGINE

BACKGROUND OF THE INVENTION

The present invention relates generally to an ignition system in an air-cooled engine, and more particularly to such an ignition system involving a magnetic coil disposed adjacent the engine flywheel and interacting with a permanent magnet mounted on the flywheel.

Modern small engines of the air-cooled variety often employ solid state ignition modules which are compact and reliable and which require virtually no maintenance due to the absence of ignition breaker points or other parts subject to wear. Such an ignition module involves, among other things, a magnetic coil whose core is located adjacent the engine flywheel. Attached to the flywheel is a permanent magnet positioned so as to periodically encounter and interact magnetically with the magnetic coil core as the flywheel rotates. This periodic interaction governs the generation and timing of a high voltage electrical potential which is applied to the engine spark plug for combustion ignition.

U.S. Pat. No. 4,375,794 shows an ignition module of the type described above which includes a generally E-shaped laminated magnetic core having three legs located substantially in the plane of the flywheel and disposed adjacent the periphery of the flywheel. One difficulty that has been noticed with this arrangement is that air flow induced by the rotating flywheel carries debris which can become lodged around the ignition module and its mounting. Since the ignition module in this position is usually covered by a blower housing, the accumulation of debris in the vicinity of the ignition module is exacerbated and removal of the debris is complicated by the necessity of removing the blower housing first. Another difficulty which has been noted with respect to the prior art is the problem of accurately setting the arcuate air gap between the legs of the core and the periphery of the flywheel. It can be a difficult adjustment to make when it is desired that the legs be radially equidistant from the flywheel.

It would be desirable to provide an arrangement of an ignition module proximate the flywheel wherein the accumulation of debris thereabout is reduced and adjustment and service of the ignition module is facilitated. Such desirable results are obtained by the present invention.

SUMMARY OF THE INVENTION

The present invention involves mounting the ignition module vertically below the periphery of the flywheel out of the path of the air flow generated by the rotating flywheel, and thereby presenting a flat, as opposed to arcuate, gap between the magnet of the flywheel and the core of the ignition module.

The permanent magnet is disposed at a discrete location near the periphery of the flywheel which is mounted on the end of the crankshaft. The working pole of the magnet faces in an axial direction toward the engine crankcase, and is exposed on the underside of the flywheel (toward the crankcase). The magnet preferably is constructed with a flat exposed surface oriented perpendicular to the axis of rotation of the flywheel.

The ignition module is attached to the outside of the engine crankcase under the periphery of the flywheel with the legs of the magnet coil core facing in the axial direction toward the underside of the flywheel. The faces of the magnetic core legs are flat and oriented perpendicular to the axis of rotation of the flywheel so as to present a flat gap between the magnetic core and the exposed working pole of the permanent magnet.

The invention according to one aspect thereof involves an internal combustion engine having a crankshaft which extends outwardly from the crankcase and has a flywheel coaxially connected thereto for rotation therewith. The engine has a cylinder extending from the crankcase along a radius of the crankshaft. A permanent magnet is affixed to the flywheel proximate the periphery thereof and has a flat face exposed on the side of the flywheel facing toward the crankcase. A solid state ignition module is attached to the crankcase and has a magnetic coil with a ferromagnetic core whose legs extend parallel to the crankshaft toward the flywheel. The legs lie in a plane perpendicular to a radius of the crankshaft, with the plane and the permanent magnet being located equally radially distant from the crankshaft. Each core leg has a flat end face disposed parallel to the flat face of the permanent magnet and is periodically juxtaposed thereto as the permanent magnet passes the ignition module upon rotation of the flywheel. An air gap defined between the flat end faces of the core legs and the flat face of the permanent magnet is adjustable by means providing for adjustment of the position of the legs of the core in a direction parallel to the crankshaft toward or away from the flywheel.

In accordance with another aspect of the invention, the flywheel has fan blades attached thereto which generate a current of air flowing generally radially away from the flywheel upon rotation thereof. A blower housing is attached to the crankcase and overlies the flywheel axially and circumferentially, and has a radial extension extending in a direction generally parallel to the cylinder and overlying the cylinder. The extension is configured to direct air flowing radially away from the flywheel over the cylinder for cooling. The solid state ignition module is attached to the crankcase at a location axially spaced from the flywheel in a direction toward the crankcase so as to be situated substantially free of the air flow generated by the flywheel.

The present invention provides the advantage of an ignition system for an air-cooled engine which can be more easily and accurately adjusted during original manufacture of the engine and also during subsequent service of the engine.

A further advantage of the present invention is that service intervals for the engine are increased and reliability is enhanced due to reduction in the accumulation of air-borne debris in the vicinity of the ignition module.

It is an object of the invention to provide an improved ignition system for an air-cooled engine which is more easily adjusted than the prior art and which is less susceptible to accumulation of debris.

Further objects and advantages of the present invention will become more apparent to the ordinarily skilled artisan from the following descriptions and drawings.

DETAILED DESCRIPTION OF THE PREFERRED EMBODIMENT

Figure 1:
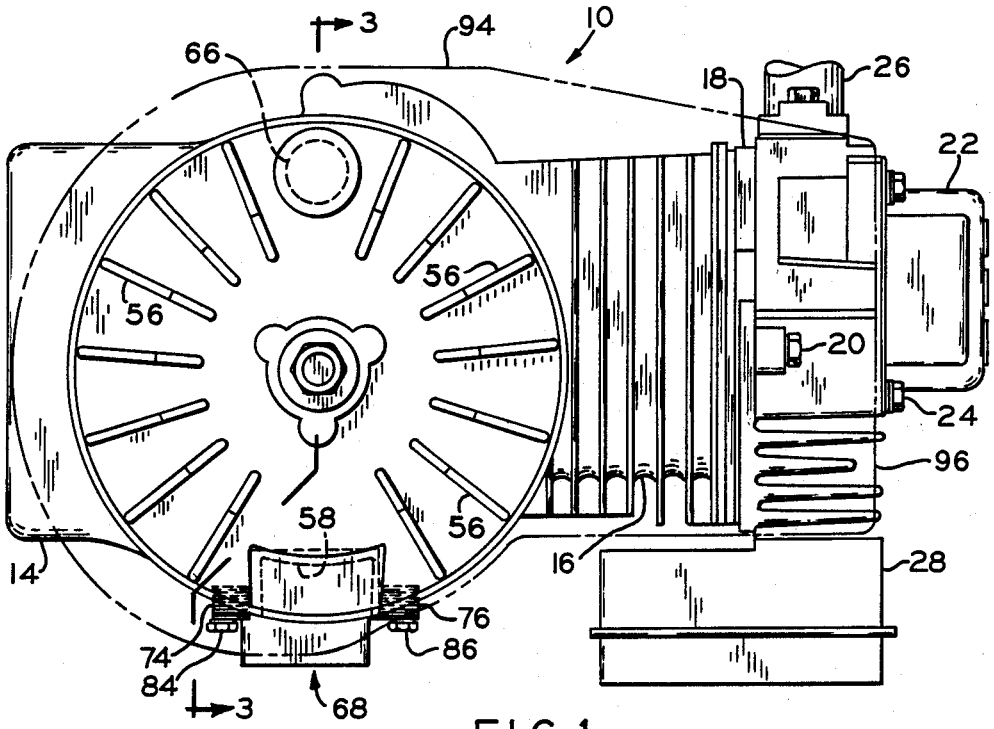
FIG. 1 is a top plan view of an air-cooled engine and ignition system in accordance with the present invention.
Figure 2:
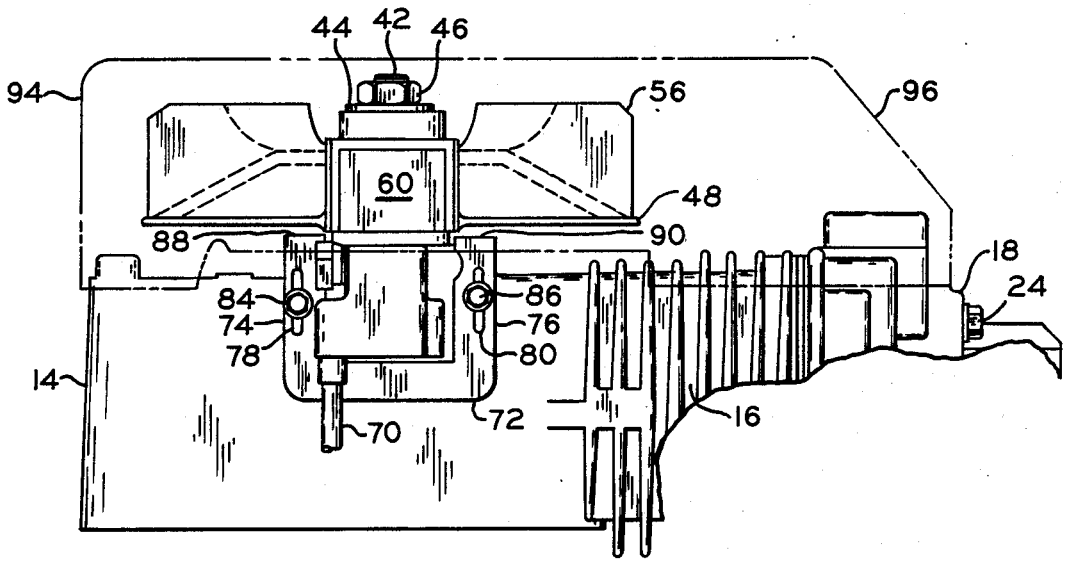
FIG. 2 is a side elevational view of the engine and ignition system of FIG. 1.
Figure 3:
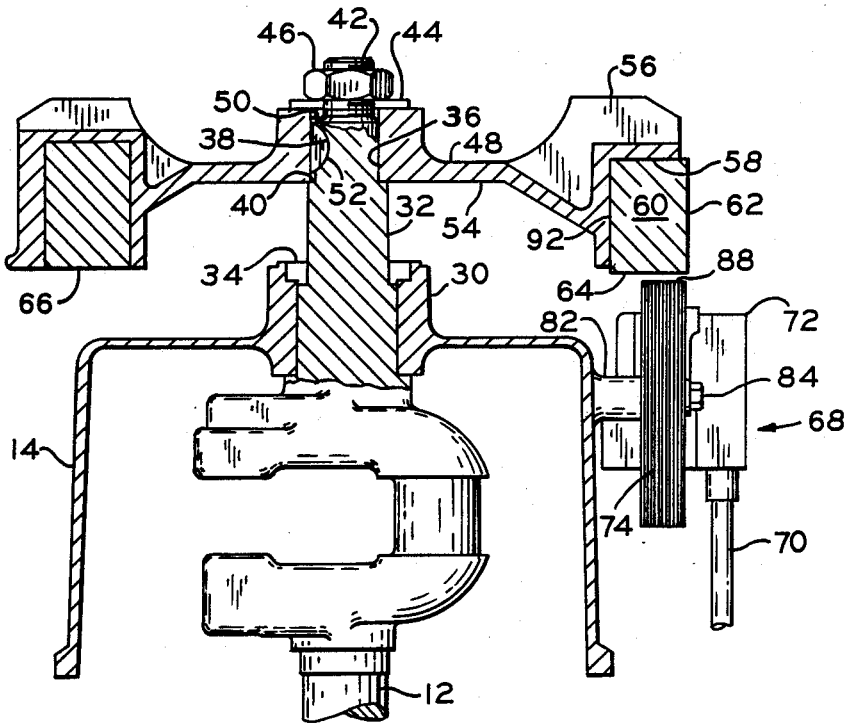
FIG. 3 is an elevational cross-sectional view of the engine and ignition system of FIG. 1 taken in the plane 3—3 of FIG. 1 and viewed in the direction of the arrows.

Referring to the drawings, there is illustrated an air-cooled single cylinder internal combustion engine 10 having a vertical crankshaft 12. In conventional manner, the engine 10 includes a crankcase 14 and a horizontally oriented cylinder 16 to which is attached a cylinder head 18 via bolts 20 valve cover 22 houses the rocker arms of an overhead valve train and is attached by bolts 24. A fuel/air intake manifold 26 is connected to a carburetor (not shown). Muffler 28 is connected to the exhaust port of cylinder head 18.

Crankshaft 12 is rotatably mounted in journal 30 and has an extension 32 protruding therethrough which is sealed with respect to crankcase 14 by oil seal 34. Extension 32 further includes an intermediate reduced portion 36 including a key slot 38 and a shoulder 40, and a terminal reduced portion 42 which is threaded to receive washer 44 and nut 46. Fitted on intermediate reduced portion 36 is a flywheel 48 which includes key slot 50 for receiving a key 52, which key is also received in key slot 38 of intermediate reduced portion 36, thereby keying together flywheel 48 and crankshaft 12 for rotation together. The underside 54 of flywheel 48 abuts and is supported in the axial direction by shoulder 40. Flywheel 48 is retained against shoulder 40 by the compressive action of washer 44 and nut 46 threaded onto the terminal portion 42 of crankshaft extension 32.

Flywheel 48 includes radially oriented fan blades 56 integrally molded therewith and lying in planes parallel to the axis of rotation of crankshaft 12. Disposed in a recess 58 on the periphery of flywheel 48 is a permanent magnet 60 having a curved outer peripheral surface 62 corresponding to the periphery of flywheel 48, and a flat, bottom surface 64 exposed on the underside of flywheel 48. Surface 64 of magnet 60 is perpendicular to the axis of rotation of crankshaft 12. The magnetic orientation of magnet 60 is such that bottom surface 64 constitutes one of the poles, i.e., the polar orientation is axial with respect to the axis of rotation of crankshaft 12. Magnet 60 can be cast in place in flywheel 48 or, alternatively, held in place in recess 58 by epoxy cement or other attachment means. A counterweight 66 is similarly attached to flywheel 48 diametrically opposite magnet 60. Counterweight 66 is sized and positioned to offset the imbalance of flywheel 48 caused by magnet 60 and restore dynamic rotational balance to flywheel 60.

The ignition system of the embodiment shown in the drawings includes in an ignition module 68 a spark coil with primary and secondary windings and a high voltage spark plug lead 70 from the secondary winding for connection to the spark plug (not shown). The arrangement of the ignition module 68 with respect to flywheel 48 and magnet 60 is such that a magnetic field is induced in the primary winding which varies in synchrony with rotation of flywheel 48. A control circuit is provided for interrupting current flow in the primary winding when that current flow is near maximum, thereby inducing a high voltage in the secondary winding for generation of a spark at the spark plug. A control coil which is positioned to be influenced by the varying magnetic field in the vicinity of ignition module 68 controls solid state circuitry which interrupts the current in the primary winding. A control module of the general type described herein is described in greater detail in U.S. Pat. No. 4,375,794, the disclosure of which is thereby incorporated by reference.

The ignition module of the embodiment described herein includes a laminated metal core 72 whose outer legs 74 and 76 include elongated holes 78 and 80 therethrough. Ignition module 68 is mounted to bosses 82 protruding from crankcase 14 by bolts 84 and 86 passing through elongated holes 78 and 80, respectively. Legs 74 and 76 are disposed below flywheel 48 and extend upwardly in a direction parallel to the axis of crankshaft 12. End faces 88 and 90 of legs 74 and 76 are flat and oriented perpendicular to the axis of crankshaft 12 so as to present a flat gap between end faces 88, 90 and working face 64 of magnet 60 as legs 74 and 76 periodically become axially aligned with magnet 60 as flywheel 48 rotates. Legs 74 and 76 lie in a plane which is substantially perpendicular to a radius of crankshaft 12 in general alignment with the periphery of flywheel 48. Consequently, permanent magnet 60 passes over both legs 74 and 76 successively as flywheel 48 rotates. Because elongated holes 78 and 80 are oriented parallel to the axis of rotation of crankshaft 12, the gap between legs 74 and 76 and magnet 60 can be easily adjusted by loosening bolts 84 and 86, repositioning ignition module 68 with the aid of a feeler gauge, and retightening bolts 84 and 86.

The gap between legs 74 and 76 and magnet 60 must be maintained constant for optimum performance. Consequently, it is necessary that the bearing support for crankshaft 12 be of the type which provides for nearly zero end play.

In the embodiment shown herein, magnet 60 has a curved inner surface 92 having the center of curvature as its outer surface 62, both of which correspond to the curvature of the periphery of flywheel 48. Alternatively, magnet 60 could be of a rectangular configuration. In addition, magnetic core 72 of ignition module 68 is illustrated herein as being assembled from essentially planar laminations for ease of manufacture. Alternatively, magnetic core 72 could be assembled from curved laminations so as to correspond to the curvature of the periphery of flywheel 48. The end faces 88 and 90 would remain flat. In this latter case, the mounting of ignition module 68 to crankcase 14 would be modified accordingly such that bosses 82 would extend radially with respect to crankshaft 12.

Fan blades 56 of flywheel 48 are oriented to generate a current of air which flows generally radially away from the center of flywheel 48 upon rotation thereof. Blower housing 94 is attached to crankcase 14 and overlies flywheel 48 axially thereof and surrounds flywheel 48 circumferentially. Blower housing 94 has a radial extension 96 extending in a direction generally parallel to cylinder 16 and overlies the same. Extension 96 is configured to direct air flowing radially away from flywheel 48 over cylinder 16 to provide cooling thereof. It should be noted that ignition module 68 is advantageously attached to crankcase 14 externally thereof at a location axially spaced from flywheel 48 in a direction toward crankcase 14 so as to be situated substantially free of the air flow generated by flywheel 48. This configuration avoids the buildup of air-borne debris on or about ignition module 68.

While the present invention has been particularly described in terms of a preferred embodiment, it will be understood that the invention is not limited thereby. Therefore, it is intended that the scope of the invention include any variations, uses or adaptations of the invention following the general principals thereof and including such departures from the disclosed embodiment as come within known or customary practice in the art to which the invention pertains and which fall within the appended claims or the equivalents thereof.

What is claimed is:

1. In an internal combustion engine having a crankcase, a crankshaft disposed in said crankcase and extending outwardly therefrom, a cylinder extending from said crankcase along a radius of said crankshaft, a flywheel having a perimetric edge, said flywheel being coaxially connected to said crankshaft outwardly of said crankcase for rotation therewith in a plane perpendicular to said crankshaft, a permanent magnet affixed to said flywheel proximate the perimetric edge thereof and having a flat face exposed on a side of said flywheel facing toward said crankcase, said flat face being disposed in a plane perpendicular to said crankshaft, the improvement in combination therewith comprising:

a solid state ignition module attached to said crankcase externally thereof and having means for generating a high voltage ignition spark in response to and in synchrony with a changing magnetic field proximate thereto, said ignition module having a magnetic coil with a ferromagnetic core, said ferromagnetic core having a plurality of core legs extending in a direction toward said flywheel generally parallel to said crankshaft and lying in a plane transverse to a radius of said crankshaft, said plane and said permanent magnet being located equally radially distant from said crankshaft, said core legs each having a flat end face disposed parallel to the flat face of said permanent magnet and periodically juxtaposed thereto as said permanent magnet passes said ignition module upon rotation of said flywheel, said flat end faces of said core legs and said flat face of said permanent magnet defining when juxtaposed a flat air gap therebetween, and means for providing adjustment in a direction parallel to said crankshaft of the position of the legs of said core with respect to said crankcase, whereby said air gap is adjustable.

2. The engine of claim 1, in which said means for providing adjustment includes a pair of elongated holes in said ignition module, said holes being elongated in a direction parallel to said crankshaft, and a pair of screws received one through each of said elongated holes, each said screw being threadedly received in said crankcase.

3. The engine of claim 2, in which said elongated holes are provided one in each of said legs of said magnetic core of said ignition module.

4. In an internal combustion engine having a crankcase, a crankshaft disposed in said crankcase and extending outwardly therefrom, a cylinder extending from said crankcase along a radius of said crankshaft, a flywheel having a perimetric edge, said flywheel being coaxially connected to said crankshaft outwardly of said crankcase for rotation therewith in a plane perpendicular to said crankshaft, a permanent magnet affixed to said flywheel proximate the perimetric edge thereof and having a flat face exposed on a side of said flywheel facing toward said crankcase, said flat face being disposed in a plane perpendicular to said crankshaft, the improvement in combination therewith comprising:

said flywheel having fan blades attached thereto and oriented to generate a current of air flowing generally radially away from said flywheel upon rotation thereof;

a blower housing attached to said crankcase and overlying said flywheel axially thereof in at least one axial direction, and surrounding said flywheel circumferentially, said blower housing having a radial extension extending in a direction generally parallel to said cylinder and overlying said cylinder, said extension being configured to direct air flowing radially away from said flywheel over said cylinder for cooling thereof;

a solid state ignition module attached to said crankcase externally thereof at a location axially spaced from said flywheel in a direction toward said crankcase so as to be situated substantially free of the air flow generated by said flywheel, said solid state ignition having means for generating a high voltage ignition spark in response to and in synchrony with a changing magnetic field proximate thereto, said ignition module having a magnetic coil with a ferromagnetic core, said ferromagnetic core having a plurality of core legs extending in a direction parallel to said crankshaft and lying in a plane transverse to a radius of said crankshaft, said plane and said permanent magnet being located equally radially distant from said crankshaft, said core legs each having a flat end face disposed parallel to the flat face of said permanent magnet and periodically juxtaposed thereto as said permanent magnet passes said ignition module upon rotation of said flywheel, said flat end faces of said core legs and said flat face of said permanent magnet defining when juxtaposed a flat air gap therebetween, and means for providing adjustment in a direction parallel to said crankshaft of the position of the legs of said core with respect to said crankcase, whereby said air gap is adjustable.

5. The engine of claim 4, in which said solid state ignition module is located on a radius of said crankshaft which is substantially perpendicular to said cylinder.

6. The engine of claim 4, in which said means for providing adjustment includes a pair of elongated holes in said ignition module, said holes being elongated in a direction parallel to said crankshaft, and a pair of screws received one through each of said elongated holes, each said screw being threadedly received in said crankcase.

7. The engine of claim 6, in which said elongated holes are provided one in each of said legs of said magnetic core of said ignition module.

8. The engine of claim 5, in which said means for providing adjustment includes a pair of elongated holes in said ignition module, said holes being elongated in a direction parallel to said crankshaft, and a pair of screws received one through each of said elongated holes, each said screw being threadedly received in said crankcase.

9. The engine of claim 8, in which said elongated holes are provided one in each of said legs of said magnetic core of said ignition module.

* * * * *